US007063298B2

(12) United States Patent
Henry

(10) Patent No.: US 7,063,298 B2
(45) Date of Patent: Jun. 20, 2006

(54) HOLDER FOR GREASE GUN

(76) Inventor: Dwayne Henry, 2662 Crocus Drive, Regina, Saskatchewan (CA) S4V 1T2

( * ) Notice: Subject to any disclaimer, the term of this patent is extended or adjusted under 35 U.S.C. 154(b) by 107 days.

(21) Appl. No.: 10/698,373

(22) Filed: Nov. 3, 2003

(65) Prior Publication Data

US 2005/0121580 A1 Jun. 9, 2005

(51) Int. Cl.
*A47F 1/00* (2006.01)

(52) U.S. Cl. ..... 248/309.1; 248/312; 222/251

(58) Field of Classification Search ..... 248/51, 248/52, 311.3, 312, 313, 314, 316.7; 222/180, 222/181.3
See application file for complete search history.

(56) References Cited

U.S. PATENT DOCUMENTS

| | | | | | |
|---|---|---|---|---|---|
| 1,647,039 | A | | 4/1927 | Fischer | |
| 3,224,644 | A | * | 12/1965 | Davis | 222/162 |
| 3,224,720 | A | * | 12/1965 | Hain | 248/313 |
| 4,171,776 | A | * | 10/1979 | Pagliaro | 239/274 |
| 4,254,926 | A | | 3/1981 | Reeberg | |
| 4,784,360 | A | * | 11/1988 | Mok | 248/313 |
| 4,848,714 | A | * | 7/1989 | Ziaylek et al. | 248/313 |
| 5,040,756 | A | * | 8/1991 | Via Cava | 248/103 |
| 5,080,240 | A | | 1/1992 | Williams | |
| 5,301,634 | A | * | 4/1994 | Ho | 119/477 |
| 5,423,508 | A | * | 6/1995 | Isenga et al. | 248/311.2 |
| 6,698,601 | B1 | | 3/2004 | Nez | |

FOREIGN PATENT DOCUMENTS

| | | |
|---|---|---|
| JP | 07-179153 | 7/1995 |
| JP | 2002-21118 | 1/2002 |

* cited by examiner

*Primary Examiner*—Ramon O. Ramirez
*Assistant Examiner*—Steven Marsh
(74) *Attorney, Agent, or Firm*—Ryan W. Dupuis; Michael R. Williams; Adrian D. Battison

(57) ABSTRACT

A grease gun holder includes a mounting plate having apertures therein for securement to an upright supporting surface, for example a wall, using suitable fasteners. A clip is provided on the mounting plate for securably receiving the tubular body of the grease gun therein. A drip tray is also provided on the mounting plate spaced below the clip. A nozzle holder secures a nozzle of the grease gun to the mounting plate above the drip tray. The holder permits a grease gun to be readily stored with minimal mess as any leakage or drips of grease which may occur from either the tubular body or the nozzle can be collected within the tray.

18 Claims, 3 Drawing Sheets

HOLDER FOR GREASE GUN

FIELD OF THE INVENTION

The present invention relates to a grease gun holder and a method of storing a grease gun using the holder which can be supported on an upright supporting surface, for example a wall.

BACKGROUND

The use of grease guns are well known for storing and dispensing grease used for lubricating various machinery and the like. Grease guns typically have a tubular body with a plunger supported therein to urge the grease outwardly through a nozzle at the free end of a dispensing tube in communication with the tubular body. A lever mechanism typically provides actuation of the plunger. These grease guns are known to leak and can be particularly messy when stored on shelves or in drawers and the like with other tools. Even when supported on a hook on a wall for example, the grease is known to leak and drip causing further mess. Furthermore the nozzle when permitted to hang freely can further cause grease to be undesirably spread due to contact with surrounding objects.

SUMMARY

According to one aspect of the present invention there is provided a holder for a grease gun having a generally tubular body, the holder comprising:

a wall mount for securement to an upright supporting surface; and a clip device mounted on the wall mount for securably receiving the tubular body of the grease gun therein.

According to a second aspect of the present invention there is provided a method of storing a grease gun having a generally tubular body, the method comprising:

providing a holder having a clip device for securably receiving the tubular body of the grease gun therein;

mounting the clip device on an upright supporting surface; and supporting the tubular body of the grease gun in the clip device.

The use of a holder as described herein permits a grease gun to be readily secured to a wall in which a clip is provided specifically for securably receiving the tubular body of a grease gun therein. Additional features of a tray or a nozzle holder can prevent further mess. The clip device by itself provides some advantage as the grease gun can be suitably oriented to minimize leakage.

There may be provided a tray supported on the wall mount below the clip device which includes side walls to form a receptacle suitable for containing a liquid therein. When a nozzle holder is supported on the wall mount for securing a nozzle of the grease gun therein, the clip device is preferably spaced outwardly from the wall mount with the nozzle holder being located directly adjacent the wall mount for locating the nozzle between the grease gun and the wall in the mounted position.

The tray is preferably supported on the wall mount below both the nozzle holder and the clip device in respective vertical alignment with each.

The nozzle holder may comprise a cradle for supporting the nozzle therein lying parallel to the wall mount.

The clip device may comprise a pair of upright flanges spaced apart from one another to define a spring clip for securing the body of the grease gun therebetween in an upright orientation. The pair of flanges may include a concave interior profile conforming to a shape of a body of the grease gun.

When the wall mount comprises a plate having mounting apertures therein, the clip device is preferably supported at one end with the tray projecting outwardly from the plate at an opposite end from the clip device.

BRIEF DESCRIPTION OF THE DRAWINGS

In the accompanying drawings, which illustrate an exemplary embodiment of the present invention.

DETAILED DESCRIPTION

Figure 1:
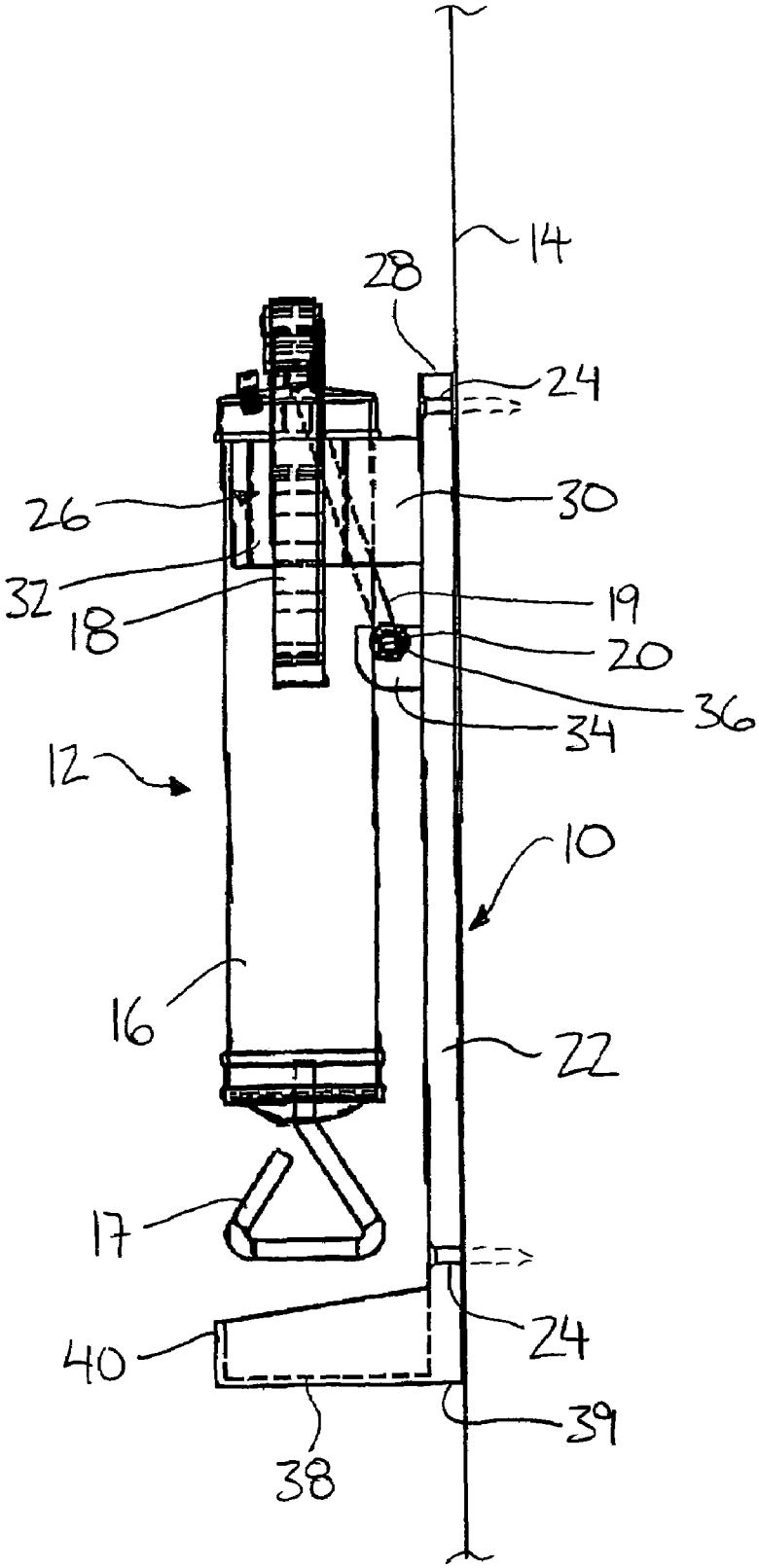
FIG. 1 is a side elevational view of the holder with a grease gun supported thereon.
Figure 3:
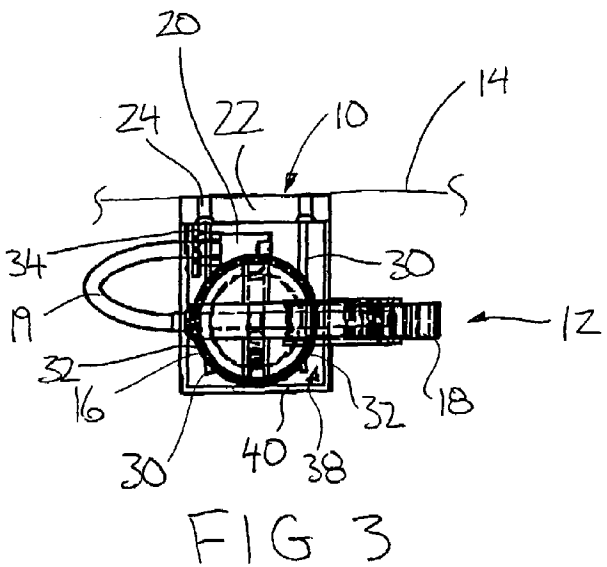
FIGS. 2 and 3 are front elevational and top plan views respectively of the holder with the grease gun shown mounted thereon.
Figure 2:
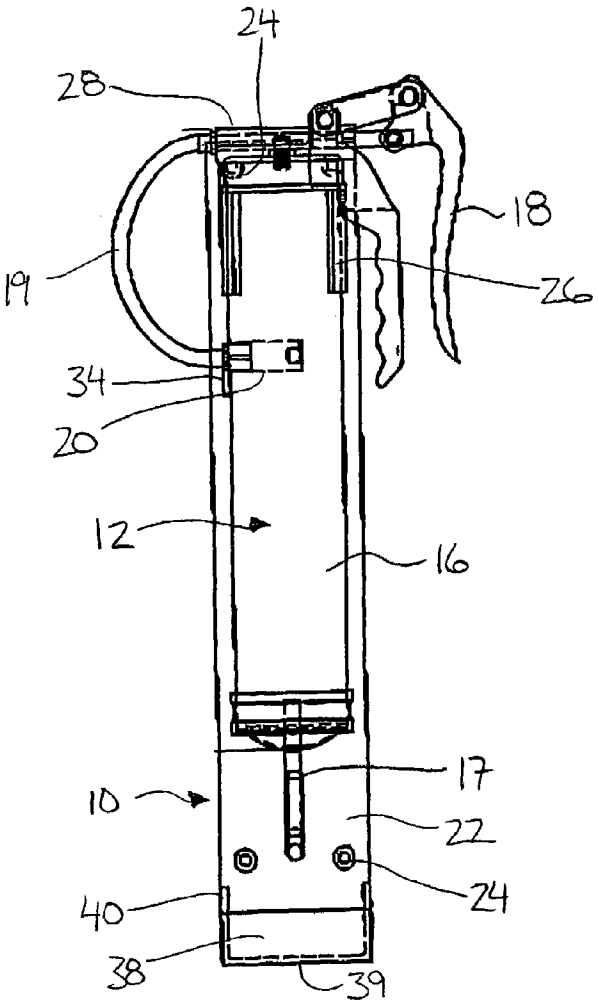
Figure 6:
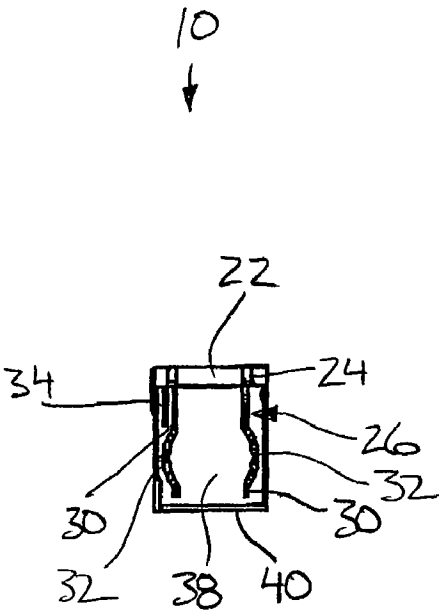
FIG. 6 is a top plan view of the holder.
Figure 5:
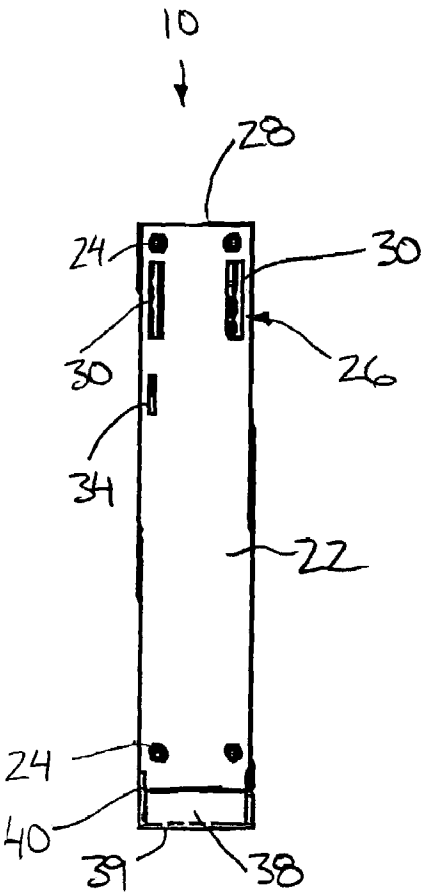
FIG. 5 is a front elevational view of the holder.
Figure 4:
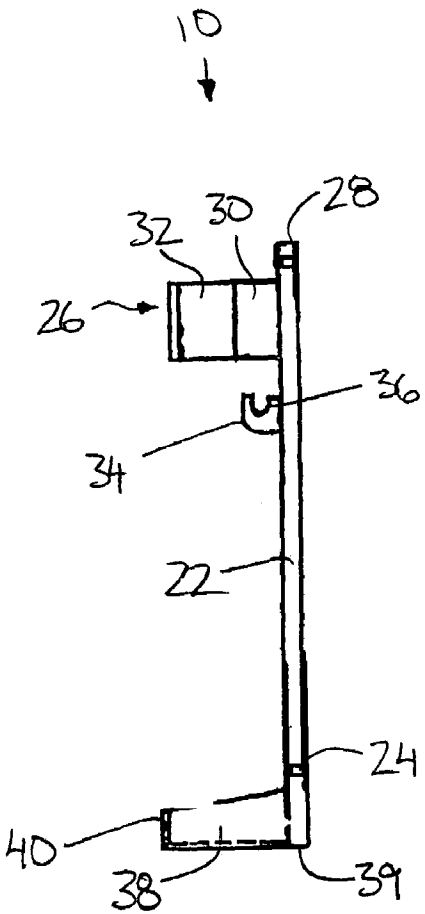
FIG. 4 is a side elevational view of the holder alone.

Referring to the accompanying drawings, there is illustrated a holder generally indicated by reference numeral 10. The holder is particularly suited for supporting a grease gun 12 on an upright supporting surface, for example a wall 14.

The gun 12 has a cylindrical body 16 for containing the grease therein. A plunger mechanism 17 actuated by a lever 18 forces the grease outwardly through a flexible dispensing tube 19 supporting a nozzle 20 at a free end thereof.

The holder includes a wall mount in the form of a mounting plate 22 which is rectangular and elongate in a vertical direction. Mounting apertures 24 are provided adjacent each of the four corners of the mounting plate 22. The mounting apertures 24 are arranged to receive suitable fasteners therethrough for securement to the wall 14. Dimensions of the mounting plate 22 are arranged to be only slightly wider and slightly longer than a conventional grease gun.

The holder further includes a clip device 26 adjacent a top end 28 of the mounting plate. The clip device comprises two vertical flanges 30 each comprising a flat band of material lying generally parallel to each other and to the longitudinal direction of the mounting plate 22. Each of the flanges includes a curved portion 32 in which the inner surface has a concave profile conforming to the cylindrical shape of the tubular body of the grease gun. The flanges 30 are suitably spaced apart for receiving the tubular body therebetween in a mounted position. The flanges are formed of a suitable spring steel or reinforced plastic to act as a conventional spring clip in which the flanges are flexed outwardly slightly when the grease gun is received therebetween so as to be biased inwardly for gripping the grease gun in the mounted position.

A nozzle holder 34 is supported on the mounting plate 22 below the clip device 26 but nearer to the top end 28 of the plate. The nozzle holder 34 comprises a vertical flange projecting outwardly perpendicular to the mounting plate 22. A U-shaped recess 36 is formed in the top edge of the flange for snugly receiving the nozzle 20 of the grease gun therein. The nozzle holder 34 thus acts as a cradle positioned directly adjacent the mounting plate 22 for supporting the nozzle 20 such that a longitudinal direction of the nozzle lies parallel to the mounting plate and the wall upon which it is supported.

A tray 38 is mounted adjacent the bottom end 39 of the mounting plate to project perpendicularly outwardly therefrom. The tray extends generally horizontally outwardly from the mounting plate when supported on a wall 14. Sides 40 are provided which project upwardly from three sides of the rectangular base of the tray 38 with the mounting plate forming the fourth side so that the sides of the tray define a receptacle suitable for containing liquid therein. The dimensions of the tray are slightly larger than the cross section of the grease gun to catch any drips or leakage that may occur from the grease gun supported in the clip device 26 supported thereabove.

In use the mounting plate 22 forming the wall of the holder is secured to a wall in a vertical orientation using appropriate fasteners. The tubular body of the grease gun is resiliently secured between the opposed flanges of the clip device in a vertical orientation. The nozzle 20 of the grease gun is received within the U-shaped recess 36 of the nozzle holder so that the nozzle lies parallel to the wall directly adjacent the mounting plate 22 so as to lie between the grease gun and the wall in the mounted position. Both the nozzle and the body of the grease gun are supported above the tray which is suitably large in dimensions to catch drips from both the nozzle and the gun which are in vertical alignment above the tray. The resilient nature of the flanges forming the clip device permits the grease gun to be readily released from the holder simply by pulling the tubular body free from the clips and the nozzle from the nozzle holder.

While one embodiment of the present invention has been described in the foregoing, it is to be understood that other embodiments are possible within the scope of the invention. The invention is to be considered limited solely by the scope of the appended claims.

The invention claimed is:

1. A grease gun holder in combination with a grease gun having a generally tubular body, a flexible dispensing tube and a nozzle at a free end of the tube, the grease gun holder comprising:

a wall mount for securement to an upright supporting surface;

a clip device mounted on the wall mount and securably receiving the tubular body of the grease gun therein;

a nozzle holder supported on the wall mount and securing the nozzle of the grease gun therein; and a tray supported on the wall mount below both the nozzle holder and the clip device in respective vertical alignment with each of the nozzle holder and the clip device, dimensions of the tray being larger than the grease gun in cross section so as to be arranged to catch drips from the grease gun.

2. The grease gun holder in combination with a grease gun according to claim 1 wherein the wall mount comprises a mounting plate, the clip device is spaced outwardly from the mounting plate and the nozzle holder is located directly adjacent the mounting plate.

3. The grease gun holder in combination with a grease gun according to claim 1 wherein the nozzle holder comprises a cradle supporting the nozzle therein lying parallel to the wall mount.

4. The grease gun holder in combination with a grease gun according to claim 1 wherein the clip device comprises a pair of flanges spaced apart from one another to define a spring clip.

5. The grease gun holder in combination with a grease gun according to claim 4 wherein the pair of flanges include a concave interior profile conforming to a shape of the body of the grease gun.

6. The grease gun holder in combination with a grease gun according to claim 1 wherein the wall mount comprises a plate having mounting apertures therein which supports the clip device at one end and the tray projecting outwardly from the plate at an opposite end from the clip device.

7. A grease gun holder in combination with a grease gun having a generally tubular body, a flexible dispensing tube and a nozzle at a free end of the tube, the holder comprising:

a wall mount for securement to an upright supporting surface;

a clip device mounted on the wall mount securably receiving the tubular body of the grease gun therein;

a nozzle holder supported on the wall mount and securing the nozzle of the grease gun therein; and a tray including side walls forming a receptacle suitable for containing a liquid therein, the tray being supported on the wall mount below both the nozzle holder and the clip device in respective vertical alignment with each of the nozzle holder and the clip device such that both the nozzle and the body of the grease gun are above the tray.

8. The grease gun holder in combination with a grease gun according to claim 7 wherein the wall mount comprises a mounting plate.

9. The grease gun holder in combination with a grease gun according to claim 8 wherein the clip device receiving the tubular body of the grease gun therein is spaced outwardly from the wall mount.

10. The grease gun holder in combination with a grease gun according to claim 9 wherein the nozzle holder supports the nozzle directly adjacent the mounting plate.

11. The grease gun holder in combination with a grease gun according to claim 7 wherein dimensions of the tray are larger than a cross section of the grease gun.

12. The grease gun holder in combination with a grease gun according to claim 7 wherein the nozzle holder comprises a cradle snugly receiving the nozzle of the grease gun therein.

13. The grease gun holder in combination with a grease gun according to claim 7 wherein the clip device comprises a pair of flanges lying parallel to and spaced apart from one another, only a portion of the pair of flanges having an inner surface comprising a concave profile conforming to the tubular body of the grease gun.

14. A grease gun holder in combination with a grease gun in combination with a grease gun having a generally tubular body, a flexible dispensing tube and a nozzle at a free end of the tube, the holder comprising:

a wall mount for securement to an upright supporting surface;

a clip device mounted on the wall mount comprising a pair of flanges lying parallel to and spaced apart from one another, only a portion of the pair of flanges having an inner surface comprising a concave profile conforming to the tubular body of the grease gun;

the clip device securably receiving the tubular body of the grease gun therein spaced outwardly from the wall mount;

a tray including side walls to form a receptacle suitable for containing a liquid therein, the tray being supported on the wall mount below the clip device; and a nozzle holder on the wall mount supporting the nozzle of the grease gun above the tray.

15. The grease gun holder in combination with a grease gun according to claim 14 wherein the wall mount comprises a mounting plate.

16. The grease gun holder in combination with a grease gun according to claim 15 wherein the nozzle holder supports the nozzle directly adjacent the mounting plate.

17. The grease gun holder in combination with a grease gun according to claim 14 wherein dimensions of the tray are larger than a cross section of the grease gun.

18. The grease gun holder in combination with a grease gun according to claim 14 wherein the nozzle holder comprises a cradle snugly receiving the nozzle therein.

* * * * *